US005891500A

United States Patent [19]

Brodie, III

[11] Patent Number: 5,891,500

[45] Date of Patent: Apr. 6, 1999

[54] PACKAGING FILMS CAPABLE OF BEING HEAT-SEALED CLOSED AND THEREAFTER PEELED OPEN

[75] Inventor: Vincent Brodie, III, Wilmington, Del.

[73] Assignee: E. I. du Pont de Nemours and Company, Wilmington, Del.

[21] Appl. No.: 729,459

[22] Filed: Oct. 11, 1996

Related U.S. Application Data

[60] Provisional application No. 60/005,142, Oct. 12, 1995.

[51] Int. Cl. [6] ..... A23B 53/00; B65D 33/22

[52] U.S. Cl. ..... 426/415; 383/210; 428/355 RA; 428/355 AC; 53/477

[58] Field of Search ..... 426/415; 383/210, 383/211, 42–58; 428/355 RA, 355 AC; 53/477

[56] References Cited

U.S. PATENT DOCUMENTS

| | | | |
|---|---|---|---|
| 4,082,877 | 4/1978 | Shadle | 428/35 |
| 4,944,409 | 7/1990 | Busche et al. | 206/632 |
| 4,983,431 | 1/1991 | Gibbons et al. | 428/34.2 |
| 5,023,121 | 6/1991 | Pockat et al. | 428/36.9 |
| 5,547,752 | 8/1996 | Yanidis | 428/349 |

FOREIGN PATENT DOCUMENTS

| | | |
|---|---|---|
| 248460 | 10/1986 | Japan . |
| 259619 | 11/1986 | Japan . |
| 1 401 880 | 12/1972 | United Kingdom . |

*Primary Examiner*—Lynette F. Smith
*Assistant Examiner*—Brenda G. Brumback
*Attorney, Agent, or Firm*—Craig H. Evans

[57] ABSTRACT

Package comprising a polymer blend of ionomer and polybutylene in which at least one seam is made up of the blend being sealed to itself.

11 Claims, No Drawings

PACKAGING FILMS CAPABLE OF BEING HEAT-SEALED CLOSED AND THEREAFTER PEELED OPEN

This application claims the benefit of U.S. Provisional Application No. 60/005,142, filed Oct. 12, 1995.

BACKGROUND OF THE INVENTION

1. Field of the Invention

The present invention relates generally to packaging films capable of being heat-sealed closed during the packaging of a product and later peeled open by an end-user or consumer. More specifically, the films of the present invention comprise innovative blends of polybutylene and certain types of ionomers.

2. Discussion Of the Prior Art

A number of conventional packaging designs include heat-sealed packaging film which require the end-user to peel open the film, when initially removing a product from the package. In such packaging applications, the heat seal should ideally be strong enough to protect the product, but not so strong as to cause the end user undue difficulty in peeling open the package.

Broadly speaking, polybutylene polymers are known to be useful in preparing peelable heat seals. Furthermore, films have been commercialized comprising blends of about 3–4 wt parts polybutylene and 96–97 weight parts zinc neutralized acid copolymer of ethylene and methacrylic acid.

Generally speaking, ionomers are well known. Ionomers are derived from acid copolymers by wholly or partially neutralizing the acid moiety of the acid copolymer with a cation. Acid copolymers are well known and generally comprise an olefin monomer (such as ethylene) which is copolymerized with an acid comonomer (such as acrylic acid or methacrylic acid).

Applicant has discovered improved heat sealable compositions for peelable packaging applications, comprising innovative blends of polybutylene and certain types of ionomers.

SUMMARY OF THE INVENTION

The instant invention is directed to packaging designs, comprising a polymer blend having excellent heat seal and tensile properties. The blend can be used as a monolayer film or as a component of a multilayer film structure.

In use, the blend composition is preferably heat sealed to itself. In opening the package, an end-user will preferably peel the package apart, causing one layer of the polymer blend to delaminate from the other layer of polymer blend (the two layers being initially heat sealed together). In a preferred embodiment, the polymeric blend preferably provides at least one package seam.

The peelable, heat sealable composition of the present invention comprises a polymeric blend of:

(1) about 90 to about 98 weight parts of an ionomer which is a member of the group consisting of:
  (a) sodium neutralized ionomer derived from at least: i. ethylene, and ii. acrylic acid or methacrylic acid; and
  (b) zinc neutralized ionomer derived from at least: i. ethylene, ii. acrylic acid or methacrylic acid, and iii. a mono-ethylenically unsaturated monomer; and
  (c) a mixture of (a) and (b) and (2) about 2 to about 10 weight parts of a polybutylene polymer.

The present invention further comprises a process for forming the above defined blend into a film layer having a thickness of at least 2 microns. Preferably, the film is heat-sealed together along one or more seams to provide a package.

DETAILED DESCRIPTION OF THE PREFERRED EMBODIMENT(S)

Ionomer Component

The ionomer component of the present invention preferably comprises about 90 to 98% by weight of the blend, with the substantial balance being a butylene polymer, such as a polybutylene homopolymer or copolymer. For a particularly desirable combination of peel performance and barrier properties, preferably the ionomer comprises from about 92 to about 95% by weight of the blend.

Ionomers of the present invention can be synthesized by conventional means, such as is disclosed in U.S. Pat. No. 3,264,272 and Canadian Patent 655,298, the disclosures of which are hereby incorporated by reference. The preferred ionomers are:

(a) sodium neutralized ionomer derived from at least: i. ethylene, and ii. acrylic acid or methacrylic acid; and/or (b) zinc neutralized ionomer derived from at least: i. ethylene, ii. acrylic acid or methacrylic acid, and iii. a mono-ethylenically unsaturated monomer.

The concentration of the ethylene component is at least 50 mole percent in the ionomer copolymer and is preferably greater than 80 mole percent, most preferably about 85 to 95 mole percent ethylene. The concentration of acrylic acid or methacrylic acid monomer in the copolymer is preferably about 0.2 mole percent to about 25 mole percent, and more preferably about from 5 to 15 mole percent.

Examples of suitable monoethylenically unsaturated monomers include methyl methacrylate, ethyl acrylate, methyl methacrylate, ethyl acrylate, vinyl acetate, vinyl alcohol, propylene, styrene, acrylonitrile, vinyl methyl ether, vinyl chloride, vinylidene chloride, vinyl fluoride, chlorotrifluoroethylene, n-butyl acrylate, isobutyl acrylate, secondary butyl acrylate, tertiary butyl acrylate, n-butyl methacrylate, isobutyl methacrylate, sec-butyl methacrylate, t-butyl methacrylate, n-pentyl acrylate, n-pentyl methacrylate, isopentyl acrylate, isopentyl methacrylate, n-hexyl acrylate, n-hexyl methacrylate, 2-ethyl-hexyl acrylate, 2-ethyl-hexyl methacrylate, stearyl acrylate, stearyl methacrylate, n-butyl ethacrylate and 2-ethyl hexyl ethacrylate. Still other monomers which can be used for the third component include mono- and di-esters of 4 to 8 carbon atoms di-carboxylic acids such as a n-butyl hydrogen maleate, sec-butyl hydrogen maleate, isobutyl hydrogen maleate, t-butyl hydrogen maleate, 2-ethyl hexyl hydrogen maleate, stearyl hydrogen maleate, n-butyl hydrogen fumarate, sec-butyl hydrogen fumarate, isobutyl hydrogen fumarate, t-butyl hydrogen fumarate, 2-ethyl hexyl hydrogen fumarate, stearyl hydrogen fumarate, n-butyl fumarate, sec-butyl fumarate, isobutyl fumarate, t-butyl fumarate, 2-ethyl hexyl fumarate, stearyl fumarate, n-butyl maleate, sec-butyl maleate, isobutyl maleate, t-butyl maleate, 2-ethyl hexyl maleate, stearyl maleate, and the like.

The preferred alkyl esters contain alkyl groups of 4 to 8 carbon atoms. The most preferred contain 4 carbon atoms. Representative examples of the most preferred esters are n-butyl acrylate, isobutyl acrylate, butyl methacrylate, isobutyl methacrylate, tertiary butyl acrylate and tertiary butyl methacrylate.

Particularly preferred are the terpolymers obtained from the copolymerization of ethylene, methacrylic acid, and alkyl esters of methacrylic acid or acrylic acid with butanol. The concentration of the ethnically unsaturated component is preferably about 0.2 to 25 mol percent, based on the weight of copolymer, preferably from 1 to 10 mole percent.

Cations are added to the above described acid copolymers to create ionomers. The preferred metal ions, regardless of the nature of the base copolymer are Na+ and Zn+<2>. These metals are preferred because they result in ionic copolymers having the best combination of improvement in solid state properties with retention of melt fabricability. The melt index of the polymer is generally about from 0.1 g./10 minutes to 1000 g./10 minutes and preferably about from 0.5 to 20 g./10 minutes.

The neutralization process brings a number of benefits including melt strength, toughness, clarity, and grease resistance. The acrylate termonomer ionomers of the present invention generally provide lower heat seal initiation temperature and improved flexible properties.

Polybutylene Component

The second blend component of the present invention is a polybutylene. Polybutylene, as used herein, refers to butylene homopolymers or copolymers based on 1-butene. Copolymers are generally prepared from 1-butene and other alpha olefins, such as, ethylene and propylene. In polybutylene copolymers, the units derived from butylene generally comprise at least about 80% of the copolymer. The butylene polymers are of film-forming molecular weight.

The polybutylene (PB) resins are generally semicrystalline highly isotactic thermoplastics derived from the polymerization of butene-1 monomer with or without other alpha-olefin monomers utilizing a catalyst, such as, a Ziegler-Natta type of catalysts or the like. Similar to polypropylene, these resins also have a spiral (or helix) molecular configuration. PB is also called polybutene-1.

Ionomer+Polybutylene

In general, the polymer blends used in the packages of the present invention comprise about 75 to 98 weight parts ionomer, and complimentarily, 2 to 25 weight parts polybutylene homopolymer or copolymer to provide 100 weight parts of ionomer and polybutylene. The specific ratios of the two principal components will vary depending on the method of formation of the film resulting from the blend, as well as the specific desired performance characteristics. For films prepared using conventional blowing techniques, up to about 10% polybutylene polymer is preferred, and about from 5 to 8% butylene polymer has been found to be particularly satisfactory. The compositions of the present invention can be in the form of an extruded film, that is, formed by melt or solution coating onto a substrate.

Polymer blends used in the present invention can contain minor quantities of other ingredients, such as conventional slip control and anti-block additives (such as silica or the like). Similarly, in those blends prepared by extrusion or coextrusion coating, conventional chill roll release additives are generally incorporated. The concentration of these additional components is typically about from 1 to 5 parts per million.

The present polymer blends are generally used in thicknesses of from about 0.1 to 0.8 mils (2.5–20.3 microns) and can be oriented by drawing using conventional film processing techniques to improve the physical properties of the films. Generally, at thicknesses of less than about 0.5 mil (12.7 microns), the blend is present as part of a multi-layered structure. At these thicknesses, packages can be prepared by conventional heat sealing techniques as known to those skilled in the art. The resulting packaging surprisingly provides excellent integrity.

The resulting packages exhibit consistency of heat seal strength on the seams over a broad temperature range. While strong enough for seal integrity, the resulting seals permit easy opening and are characterized by an interfacial peel, as opposed to delamination at the interface. At the same time, seals in accordance with the present invention exhibit a noticeable whitening on opening, providing visual evidence of any seal tampering of the package. Heat seals can be prepared at initiation temperatures of as low as about 80° C. The heat seals produced show excellent retention of heat seal strength over aging. The polymer blends can be prepared by dry blending or melt blending of the components in conventional pellet form.

The invention is further illustrated in the following specific examples (parts or percentages are by weight unless otherwise indicated).

EXAMPLES and COMPARATIVE EXAMPLES

Seven different ionomer resins were dry blended in a large blender with three different types of polybutylene resins. The mix ratios were 90% or 95% ionomer resin and 10% and 5% of the polybutylene resin for a total of 42 different blends being produced. N-oleyl palmitanide slip additive and silica anti-block additive were also added to these blends at a rate of 10,000 ppm slip and 5000 ppm of anti-block, respectively.

The blown film unit used a 2 ½" (6.4 cm) Welex extruder and a 6" (15 cm) Victor die. The melt temperature of the resins was 360° F. (182° C.) for the blends containing the "Surlyn" 1705 and the "Surlyn" 1652, 390° F. (199° C.) for the blends containing the "Surlyn" 1650, and 400° F. (204° C.) for the remaining blends that were tested. The films produced were 2 mils thick, 24" (61 cm) wide, and 500 feet (152 meters) long. The blend compositions are summarized in Table I. The ionomers are identified in Table I.

The films were heat sealed using conventional heat sealing equipment. The seals were made at a pressure of 30 psi (207 mPa), with 1 second dwell time, at temperatures of from 200° F. to 300° F. (93°–149° C.) at twenty degree (° F.) increments. The seals were cut to 1" (2.54 cm) wide and pulled on an Instron® tensile tester. Three seals were tested for each reported result.

The heat seals of films made from some blends, on testing, exhibited a seal strength that was higher or lower than the target peelable range of 350 to 1400 grams/inch (grams/2.54 cm). Factors contributing to peel strength, other than blend composition, include extrusion temperature, blending technique used to mix the ionomer and the polybutylene, and type of extrusion equipment.

Those blends exhibiting a peel strength higher than 1400 grams/inch (grams/2.54 cm) are identified in Table I as (H), while those having a peel strength lower than 350 grams/inch (grams/2.54 cm) are identified as (L).

Packages prepared from the films, with the polybutylene sealed to itself, will exhibit an excellent combination of package integrity and a peelable seal. If these procedures are repeated, using higher concentrations of the polybutylene resins, the strength of the package seal will be lower.

TABLE I

IONOMER/POLYBUTYLENE BLENDS
BLENDS RUN ON BLOWN FILM LINE

| BLEND | IONOMER | NEUTRALIZER ION | MELT INDEX | ACID CONTENT | NEUTRALIZATION AMOUNT | PERCENT IN BLEND | POLYBUTYLENE TYPE | PERCENT IN BLEND |
|---|---|---|---|---|---|---|---|---|
| 1 | A[1] | SODIUM | 1.3 | MEDIUM | MEDIUM | 95% | SHELL DP1560 | 5% |
| 2 | " | " | " | " | " | 90% | | 10% |
| 3 | " | " | " | " | " | 95% | SHELL 1600SA | 5% |
| 4 | " | " | " | " | " | 90% | | 10% |
| 5 | " | " | " | " | " | 95% | SHELL 1710A | 5% |
| 6 | " | " | " | " | " | 90% | | 10% |
| 7 | B | SODIUM | 2.8 | HIGH | HIGH | 95% | SHELL DP1560 | 5% |
| 8 | " | " | " | " | " | 90% | | 10% |
| 9 | " | " | " | " | " | 95% | SHELL 1600SA | 5% |
| 10 | " | " | " | " | " | 90% | | 10% |
| 11 | " | " | " | " | " | 95% | SHELL 1710A | 5% |
| 12 | " | " | " | " | " | 90% | | 10% |
| 13 | C[1] | SODIUM | 0.9 | HIGH | VERY HIGH | 95% | SHELL DP1560 | 5% |
| 14 | " | " | " | " | " | 90% | | 10% |
| 15 | " | " | " | " | " | 95% | SHELL 1600A | 5% |
| 16 | " | " | " | " | " | 90% | | 10% |
| 17 | " | " | " | " | " | 95% | SHELL 1710A | 5% |
| 18 | " | " | " | " | " | 90% | | 10% |
| 19 | D[1] | ZINC | 5.5 | HIGH | LOW | 95% | SHELL DP1560 | 5% |
| 20 | " | " | " | " | " | 90% | | 10% |
| 21 | " | " | " | " | " | 95% | SHELL 1600SA | 5% |
| 22 | " | " | " | " | " | 90% | | 10% |
| 23 | " | " | " | " | " | 95% | SHELL 1710A | 5% |
| 24 | " | " | " | " | " | 90% | | 10% |
| 25 | E[1] | ZINC | 1.0 | MEDIUM | HIGH | 95% | SHELL DP1560 | 5% |
| 26 | " | " | " | " | " | 90% | | 10% |
| 27 | " | " | " | " | " | 95% | SHELL 1600SA | 5% |
| 28 | " | " | " | " | " | 90% | | 10% |
| 29 | " | " | " | " | " | 95% | SHELL 1710A | 5% |
| 20 | " | " | " | " | " | 90% | | 10% |
| 31 | F[1] | ZINC | 1.6 | MEDIUM/ HIGH | MEDIUM/LOW | 95% | SHELL DP1560 | 5% |
| 32 | " | " | " | " | " | 90% | | 10% |
| 33 | " | " | " | " | " | 95% | SHELL 1600SA | 5% |
| 34 | " | " | " | " | " | 90% | | 10% |
| 35 | " | " | " | " | " | 95% | SHELL 1710A | 5% |
| 36 | " | " | " | " | " | 90% | | 10% |
| 37 | G[1] | ZINC | 5.2 | LOW | VERY/LOW | 95% | SHELL DP1560 | 5% |
| 38 | " | " | " | " | " | 90% | | 10% |
| 39 | " | " | " | " | " | 95% | SHELL 1600SA | 5% |
| 40 | " | " | " | " | " | 90% | | 10% |
| 41 | " | " | " | " | " | 95% | SHELL 1710A | 5% |
| 42 | " | " | " | " | " | 90% | | 10% |

[1]85–95 mole % ethylene/balance methacrylic acid (prior to neutralization)
[2]80 mole % ethylene/10 mole % methacrylic acid/10 mole % isobuyl acrylate (prior to neutralization)

HEAT SEAL TESTING

The 2 mil blown films and the coextrusion coated structures were tested for heat seal strength to determine if peelable seals could be obtained. The seals were made on a laboratory Sentinel type heat sealer using conditions of 30 psi pressure and 1 second dwell time. A slip sheet of 0.00048" polyester film was used on the 2 mil films to prevent them from sticking to the heat seal bar. the heat seals were made through a temperature range of 200° F. to 300° F. (93°–149° C.) in 20° F. (13.3° C.) increments. Testing of the heat seals was initially done the same day the heat seals were made and the results are summarized on Tables II and III.

Table III shows the heat seal results obtained on several of the ionomer/polybutylene blends. These results show that a consistent peelable seal can be obtained with these blends. The peel seal values are relatively consistent over a broad temperature range and this Table shows that different blends can produce different peel seal values. This Table also shows that when using the same ionomer, different polybutylene types will give different heat seal results. This Table also shows that when using the same components in the blend, the higher the amount of polybutylene, the lower the heat seal value will be.

Heat seals were also tested "as is" and after 1, 3, 7, 14, 21, and 28 days of aging. This was done to see if the seals would keep their seal strength over time. Table III shows results obtained on several of the ionomer/polybutylene blends in this testing. These results show that peelable heat seals can be obtained and also maintained over a period of time. This is important when peelable seals are used in packages so that the seal values don't fall off over time and possibly cause the bag to open during distribution.

The test results indicate that excellent peelable-sealed packages can be prepared with these polymer blends.

TABLE II

HEAT SEAL RESULTS
SEALS MADE AT 30PSI-1SEC.
SEAL RESULTS IN GRAMS/INCH

| | HEAT SEAL TEMPERATURES | | | | | |
|---|---|---|---|---|---|---|
| BLEND | 200° F. (93° C.) | 220° F. (104° C.) | 240° F. (116° C.) | 260° F. (127° C.) | 280° F. (138° C.) | 300° F. (149° C.) |
| 8 | 34 | 402 | 548 | 647 | 630 | 707 |
| 7 | 39 | 557 | 1407 | 1251 | 1597 | 1636 |
| 12 | 165 | 889 | 864 | 891 | 1121 | 924 |
| 17 | 234 | 594 | 615 | 449 | 721 | 599 |
| 20 | 312 | 624 | 767 | 776 | 782 | 784 |
| 36 | 133 | 437 | 595 | 606 | 724 | 666 |
| 26 | 204 | 264 | 377 | 474 | 470 | 600 |
| 25 | 370 | 775 | 970 | 1268 | 1140 | 1602 |
| 28 | 147 | 265 | 272 | 431 | 393 | 431 |
| 27 | 418 | 839 | 655 | 1122 | 1149 | 1082 |
| 30 | 273 | 366 | 376 | 404 | 523 | 546 |
| 29 | 579 | 640 | 713 | 767 | 818 | 1044 |
| 42 | 594 | 962 | 795 | 851 | 1102 | 945 |

TABLE III

HEAT SEAL - AS IS AND AGED
SEALS MADE AT 30PSI-1SEC

| BLEND | SEAL TEMP °F.(°C.) | AS IS | 1 DAY | 3 DAYS | 7 DAYS | 14 DAYS | 21 DAYS | 28 DAYS |
|---|---|---|---|---|---|---|---|---|
| 4 | 200(93) | 75 | 32 | 45 | 47 | 34 | 38 | 32 |
| | 220(104) | 462 | 213 | 229 | 222 | 213 | 500 | 223 |
| | 240(116) | 298 | 284 | 314 | 280 | 269 | 307 | 290 |
| | 260(127) | 545 | 358 | 398 | 358 | 324 | 318 | 360 |
| | 280(138) | 593 | 394 | 402 | 422 | 403 | 376 | 419 |
| | 300(149) | 635 | 443 | 385 | 432 | 319 | 418 | 417 |
| 3 | 200(93) | 32 | 116 | 71 | 122 | 117 | 95 | 63 |
| | 220(104) | 618 | 587 | 666 | 566 | 579 | 534 | 578 |
| | 240(116) | 703 | 617 | 619 | 648 | 594 | 632 | 851 |
| | 260(127) | 773 | 700 | 697 | 708 | 692 | 728 | 744 |
| | 280(138) | 845 | 767 | 730 | 769 | 726 | 757 | 752 |
| | 300(149) | 886 | 860 | 845 | 818 | 826 | 843 | 1006 |
| 5 | 200(93) | 61 | 111 | 153 | 92 | 57 | 199 | 59 |
| | 220(104) | 665 | 679 | 633 | 628 | 677 | 604 | 700 |
| | 240(116) | 717 | 726 | 714 | 684 | 664 | 665 | 909 |
| | 260(127) | 750 | 757 | 754 | 782 | 694 | 705 | 715 |
| | 280(138) | 835 | 776 | 791 | 874 | 848 | 761 | 856 |
| | 300(149) | 989 | 843 | 824 | 909 | 886 | 831 | 898 |

We claim:

1. A film comprising a polymeric blend of:

(A) about 90 to about 98 weight parts of an ionomer which is a member of the group consisting of:

(a) sodium neutralized ionomer derived from at least: i. ethylene, and ii. acrylic acid or methacrylic acid;

(b) zinc neutralized ionomer derived from at least: i. ethylene, ii. acrylic acid or methacrylic acid, and iii. a mono-ethylenically unsaturated monomer; and (c) mixtures of (a) and (b), and (B) about 2 to about 10 weight parts of a polybutylene polymer.

2. A film of claim 1 prepared by blown or cast film techniques.

3. A package comprising a film derived from the following:

(A) about 90 to about 98 weight parts of an ionomer which is a member of the group consisting of:

(a) sodium neutralized ionomer derived from at least: i. ethylene, and ii. acrylic acid or methacrylic acid; and (b) zinc neutralized ionomer derived from at least: i. ethylene, ii. acrylic acid or methacrylic acid, and iii. a mono-ethylenically unsaturated monomer; and (B) about 2 to about 10 weight parts of a polybutylene polymer, wherein the film is extruded onto a preformed substrate.

4. A package of claim 3 wherein the polybutylene polymer consists essentially of polybutylene homopolymer.

5. A package of claim 3 wherein the polybutylene polymer is a copolymer based on 1-butene and other alpha olefins.

6. A package of claim 5 wherein the polybutylene copolymer consists essentially of ethylene-butylene copolymer.

7. A package of claim 3 wherein the film has a thickness of about from 2 to 200 microns.

8. A package of claim 7 wherein the film has a thickness of about from 3 to 75 microns.

9. A process for the preparation of a package containing moist food product by forming a polymeric blend of (A) about 90 to about 98 weight parts of an ionomer which is a member of the group consisting of:

(a) sodium neutralized ionomer derived from at least: i. ethylene, and ii. acrylic acid or methacrylic acid; and (b) zinc neutralized ionomer derived from at least: i. ethylene, ii. acrylic acid or methacrylic acid, and iii. a mono-ethylenically unsaturated monomer; and (B) about 2 to about 10 weight parts of a polybutylene polymer;

forming the resulting blend into a film having a thickness of at least 2 microns; enveloping a moist food product in the film; and sealing the resulting package by heat sealing the polymeric blend to itself.

10. A process of claim 9 wherein the polymer blend is prepared by blown film techniques.

11. A process of claim 10 wherein the polymer blend is coextruded with at least one second polymer.

* * * * *